US009622567B2

(12) United States Patent
Kwon

(10) Patent No.: US 9,622,567 B2
(45) Date of Patent: Apr. 18, 2017

(54) CLEANING BROOM

(71) Applicant: Yungil Kwon, Gyeonggi-do (KR)

(72) Inventor: Yungil Kwon, Gyeonggi-do (KR)

( * ) Notice: Subject to any disclaimer, the term of this patent is extended or adjusted under 35 U.S.C. 154(b) by 0 days.

(21) Appl. No.: 14/913,478

(22) PCT Filed: Sep. 24, 2013

(86) PCT No.: PCT/KR2013/008515
§ 371 (c)(1),
(2) Date: Feb. 22, 2016

(87) PCT Pub. No.: WO2015/046634
PCT Pub. Date: Apr. 2, 2015

(65) Prior Publication Data

US 2016/0198840 A1 Jul. 14, 2016

(30) Foreign Application Priority Data

Sep. 24, 2013 (KR) ..... 10-2013-0113014

(51) Int. Cl.

| | |
|---|---|
| ***A46B 3/10*** | (2006.01) |
| ***A46B 9/10*** | (2006.01) |
| ***A46B 7/02*** | (2006.01) |
| ***A46B 3/08*** | (2006.01) |
| ***A46B 5/00*** | (2006.01) |
| ***A46B 3/14*** | (2006.01) |

(52) U.S. Cl.
CPC ..... *A46B 7/023* (2013.01); *A46B 3/08* (2013.01); *A46B 3/10* (2013.01); *A46B 3/14* (2013.01); *A46B 5/0075* (2013.01); *A46B 9/10* (2013.01); *A46B 2200/302* (2013.01)

(58) Field of Classification Search
CPC ..... A46B 2200/302; A46B 3/00; A46B 3/08; A46B 3/10; A46B 3/14; A46B 7/00; A46B 7/02; A46B 9/00; A46B 9/08; A46B 9/10; A46B 9/12; A46B 15/00
USPC ..... 15/168–175, 159.1, 191.1, 201, 204, 15/207.2
See application file for complete search history.

(56) References Cited

U.S. PATENT DOCUMENTS

| | | | | | |
|---|---|---|---|---|---|
| 3,029,455 | A * | 4/1962 | Siculan | A47L 13/52 15/144.4 |
| 5,375,288 | A * | 12/1994 | Seagren | A46B 9/10 15/143.1 |
| 2004/0031116 | A1 | 2/2004 | Coleman | |

FOREIGN PATENT DOCUMENTS

| | | | |
|---|---|---|---|
| GB | 2367486 | * | 4/2002 |
| JP | 2002-125902 | A | 5/2002 |
| KR | 20-1995-0003962 | Y1 | 5/1995 |
| KR | 1995-0003962 | Y1 | 5/1995 |
| KR | 20-0198351 | Y1 | 10/2000 |

(Continued)

*Primary Examiner* — Mark Spisich
(74) *Attorney, Agent, or Firm* — Garrett James O'Sullivan

(57) ABSTRACT

The cleaning broom is disclosed.
The cleaning broom according to the present invention comprises: a rod-shaped handle that is formed long in one direction so that the user can hold the broom by hand; the comb portion that consists of multiple comb members and is attached to the lower part of the handle to sweep cleaning objects; and the conversion unit that allows to adjust the arrangement angle of the comb members between the first mode where the comb members are arranged in parallel with the handle and the second mode where the comb members are arranged to intersect with the handle.

8 Claims, 6 Drawing Sheets

(56) References Cited

FOREIGN PATENT DOCUMENTS

| | | | |
|---|---|---|---|
| KR | 20-2010-0004607 | U | 5/2010 |
| KR | 10-2012-0031570 | A | 4/2012 |

* cited by examiner

CLEANING BROOM

TECHNICAL FIELD

The present invention relates to a cleaning broom that has been designed to be useful for sweeping both large and small outdoor areas.

BACKGROUND ART

Cleaning brooms can be divided into indoor brooms and outdoor brooms depending on where they are used, and some are used in both indoor and outdoor areas. Conventional brooms consist of handle portion for gripping the broom, comb portion where comb members are tied in bundles for sweeping debris, and coupling portion for binding the handle portion and the comb portion.

There are various types of conventional broom. A broom of which comb portion is arranged in a long line is suitable for sweeping a large area, but not for sweeping a narrow area such as corner. You can of course sweep a narrow area by changing the mode of broom, but this is very uncomfortable.

In addition, in the case of conventional brooms that are mainly used for sweeping street or yard, comb members are not aligned in a row but tied in bundles and comb members are formed to be long and flexible. This type of broom, however, has a comb portion fixed, and users may feel uncomfortable when sweeping a relative large or small area including corners. In particular, since people press comb portion when sweeping a small area, there is a problem that comb members lose elasticity and do not return to its original position after being bent.

On the other hand, conventional brooms usually have comb members made of plastic or bamboo: plastic material loses elasticity and gets hard after use for a certain period of time, resulting in efficiency drops; bamboo material is vulnerable to abrasion, shortening the service life.

Furthermore, brooms widely used for street cleaning have a problem that an economical production is difficult to achieve due to comb members. That is, since the aforesaid comb members are produced through injection mold process with molten plastic, there is a problem that it is difficult to reduce material costs and processing costs.

SUMMARY OF INVENTION

Technical Problem

The present invention aims to resolve the aforesaid problems by providing a cleaning broom of which comb portion can be spread wide to sweep a large area at a time and be narrowed to sweep a small area such as corner and by improving the material of comb members for an economic production of broom.

Solution to Problem

Fort the objects above, the cleaning broom of the present inventions comprises: a rod-like handle formed long in one direction so that the user can hold by hand; a comb portion consisting of multiple comb members and installed on the lower part of the handle to sweep the cleaning objects; and a conversion unit that allows users to adjust the arrangement angle of the comb members between the first mode where the comb members are arranged in parallel with the handle and the second mode where the comb members are arranged to cross with the handle.

Beneficial Effects

Because the cleaning broom of the present invention can change between cleaning modes according to cleaning targets and conditions: wide mode to spread the comb members and narrow mode to narrow the comb members, the user has the advantage of effective and easy cleaning.

In addition, the cleaning broom of the present invention is durable because its comb members are made of coconut wood which is excellent in wear resistance and elasticity, and has an advantage to remove at a time cleaning objects attached to the bottom.

Furthermore, the cleaning broom is not only economical but durable because it employs a very simple structure to change the modes of comb members, and also very practical as a daily necessity.

BEST MODE FOR CARRYING OUT THE INVENTION

Figure 1:
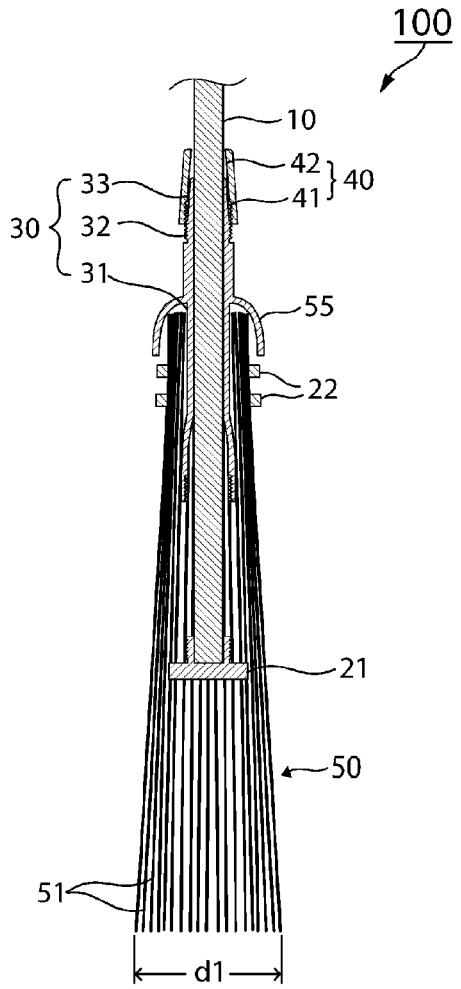
FIG. 1 is a schematic cross-sectional view of the narrow mode of the cleaning room according to the first embodiment of the present invention.

The cleaning broom of the present invention is characterized in that it comprises: a rod-like handle formed long in one direction so that the user can hold by hand; a comb portion consisting of multiple comb members and installed on the lower part of the handle to sweep the cleaning objects; and a conversion unit that allows users to adjust the arrangement angle of the comb members between the first mode where the comb members are arranged in parallel with the handle and the second mode where the comb members are arranged to cross with the handle.

According to the present invention, the handle is coupled to the comb members so as to enable a relative movement along the longitudinal direction of the handle; the conversion unit is coupled to the lower part of the handle; and the supporting plate has cross-sectional area larger than that of the handle so that the comb members change to the first mode when the handle moves to the lower part of the comb members while the comb members change to the second mode when the handle moved to the upper part of the comb members.

In addition, the conversion unit is formed in a loop shape to be elastically compressible and extendable; and a coupling band is provided to press the upper part of the comb members toward the handle so that the comb members come into a close contact with the handle, and they are coupled to the outer surface of the handle.

In addition, the conversion unit is formed in a hollow tubular shape so that it can be fitted to the lower part of the handle and movably coupled to the handle; and a connector portion is provided with a joint formed on its outer peripheral surface that are brought into a close contact with the comb members.

More specifically, in the first embodiment of the present invention, the connector portion may consist of the first connector and the second connector. The first connector is formed in a hollow tubular shape so as to be fitted to the lower part of the handle and coupled movably to the handle and comprises: a joint that is brought into a close contact with the comb members; the first fastening section that is formed extending from the joint, with male threads on its outer peripheral surface; a tightening portion that is formed extending from the rear end of the first threaded portion, with outer diameter getting smaller along the longitudinal direction of the handle. The second connector is formed in a hollow tubular shape so as to be fitted to the handle and screwed on the first connector and comprises: the second fastening section with male threads formed on its inner peripheral surface; a pressing portion that is formed extending form the second fastening section, with inner diameter that is formed to be narrower than that of the tightening portion. When the second connector is screwed to the first connector, the pressing portion presses the tightening portion toward the handle so that the first connector is coupled to the handle by interference fit.

In addition, in the first embodiment, the tightening portion of the first connector may be formed with slit portion that is cut along the longitudinal direction of the handle.

And the first connector further comprises a cover unit that is formed extending along the radial direction of the handle in order to the cover the upper part of comb members between the joint and the coupling portion.

In the present invention, the connector portion may comprise a mounting portion that is removably coupled to the supporting plate. In the back side of the supporting plate, hollow protrusions are provided to be fitted to the handle, and the mounting portion of the connector portion can be removably coupled to the protrusions of the supporting plate.

More specifically, threads are formed on the protrusions of the supporting plate and on the mounting portion of the connector portion so that the supporting plate can be removably coupled to the connector portion in a screw fastening method.

On the other hand, it is preferred in the present invention that the comb members are made of coconut wood.

Embodiments of the Invention

Hereinafter, with reference to the attached drawings, the cleaning broom according to the first embodiment of the present invention will be described in more detail.

Figure 2:
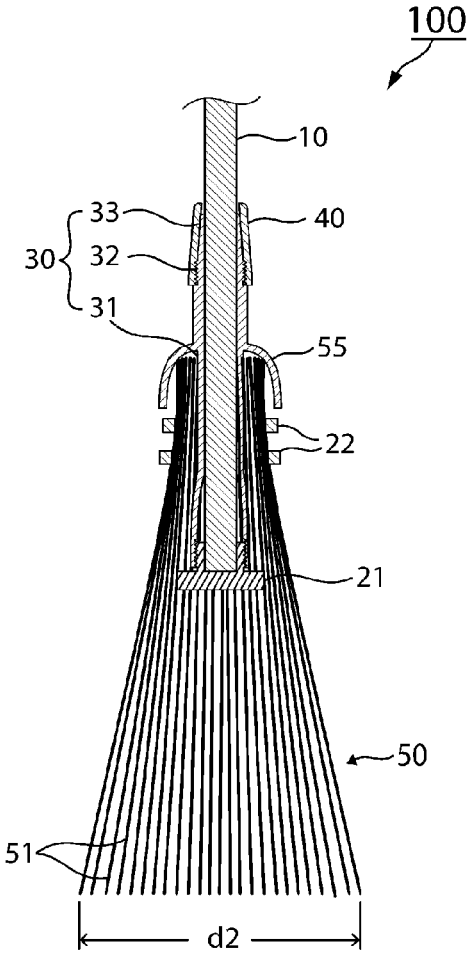
FIG. 2 is a schematic cross-sectional view after change to wide mode of the cleaning broom shown in FIG. 1.

FIG. 1 is a schematic cross-sectional view of the cleaning broom in a narrow mode according to the first embodiment of the present invention; FIG. 2 is a schematic cross-sectional view of the cleaning broom in a wide mode that has been shown in FIG. 1; and FIG. 3 is a schematic perspective view for describing the conversion unit of the cleaning broom.

Figure 3:
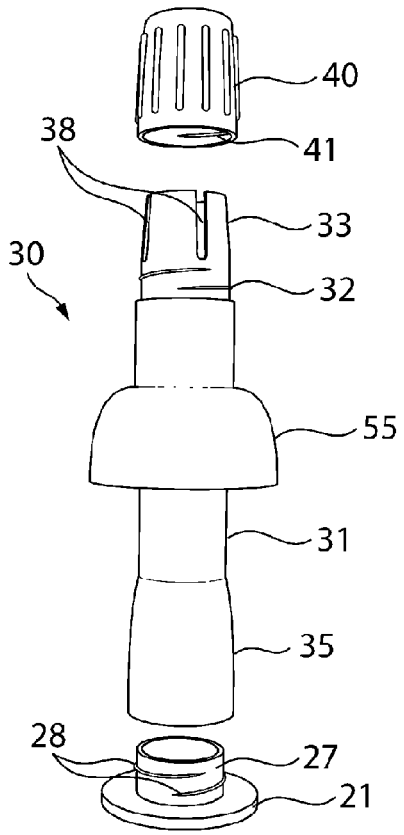
FIG. 3 is a schematic perspective view illustrating the conversion unit of the cleaning broom.

With reference to the FIGS. 1-3, the cleaning broom (100) according to a first embodiment of the present invention consists of the handle (10), the comb portion (50), and the conversion unit.

The handle (10) is made in a rod shape extending in one direction so that the user can hold the handle by hand. The length of the handle (10) may vary depending on the applications: the handle is made long for outdoor use such as road, yard, and square while it is made relatively short for indoor use, such as the waist height of a person.

The handle (10) is usually made of wood as in the first embodiment, but it may be made of plastic in a hollow shape.

The comb portion (50) is a portion to sweep cleaning objects and structured as a bundle of multiple comb members (51). The comb members (51) are formed thin and long with a length of several tens of centimeters and a thickness of several millimeters. The multiple comb members (51) are coupled to the lower part of the handle (10).

Conventional comb members (51) are made of bush clover wood, plastic, bamboo, etc. But the present invention is characterized in that it uses coconut wood.

There are two advantages in using coconut wood. Above all, coconut wood is suitable for use as comb members since it is excellent in wear resistance as well as in elasticity compared with other kinds of wood. In other words, bush clover wood or bamboo is poor in hardness and wear resistance and has a short service life because the portion in contact with ground gets quickly worn, but the coconut wood is excellent in wear resistance and can be used for a long period of time.

In addition, coconut wood has an excellent elasticity compared with other woods. Comb members must be bent well and maintain at least some degree of elastic tensile force. That is, if the user presses the broom while in contact with the ground, comb members are bent making a wider contact area with the ground and then sweep cleaning objects by an elastic force in the pressurized state. However, if the strength of the comb members is too high, they are not bent well and the cleaning efficiency drops. Coconut wood is the most suitable for comb members (51) with an excellent wear resistance and elasticity.

And, since the coconut tree is widely cultivated in Southeast Asia, including the Philippines and Indonesia, the coconut wood can be provided economically compared to plastic, bamboo, and bush clover wood. This is why the coconut wood is used for comb members in the present invention.

Conventional broom is completed by simply coupling the comb members to the lower part of the handle. But, the present invention is characterized in that it comprises a conversion unit to change modes: wide mode to spread the comb portion (50); and narrow mode to narrow the comb portion (50).

The conversion unit enables comb members (51) to change between two modes: the first mode to gather the lower part of the comb members (51) toward the center of the handle (10); the second mode to widen the lower part of the comb members (51) outward from the center of the handle (10).

In the first embodiment, the conversion unit comprises a supporting plate (21) a coupling band (22) and a connector portion. And the connector portion is composed of the first connector (30) and the second connector (40).

The supporting plate (21) is coupled to the lower part of the handle (10). The supporting plate (21) has a cross-sectional area larger than that of the handle (10). In this embodiment, the supporting plate (21) is formed in a circular plate shape. Since the supporting plate (21) has a radius lager than the handle (21), the supporting plate (21) is provided to protrude to the handle (10). However, the supporting plate is not limited to circular shape but may have polygonal or elliptical shape, including square.

And the supporting plate (21) has hollow protrusions (27) on its back side. In this case, the hollow shape includes tube shape where both the front and the rear of the protrusions are drilled as well as groove shape where the front is blocked by the supporting plate (21) and the inner part is recessed. In this embodiment, the protrusion (27) is formed in a concave groove shape. As the protrusion (27) is fitted to the handle (10), the supporting plate (21) is coupled to the handle (10). In this embodiment, the protrusion (27) has threads (28) on its outer peripheral surface.

The first connector (30) and the second connector (40) are hollow tube-shaped and fitted to the handle (10) to slide on the handle (10), and the first connector (30) is removably screwed to the second connector (40).

The first connector (30) is fitted to the lower part of the handle (10). The first connector (30) has inner diameter slightly larger than the handle (10) to enable relative movement of the handle (10) and the first connector (30). The first connector (30) comprises the joint (31), the first fastening section (32), the tightening portion (33), and the mounting portion (35). The joint (31) is the lowermost part of the first connector (30). The comb members (51) are adhered to the outer peripheral surface of the joint (31) by the coupling band (22).

The first fastening section (32) is formed extending upwardly from the joint (31) and has male threads on its outer peripheral surface so as to be coupled to the second connector (40). The tightening portion (33) is formed extending upwardly from the first fastening section (32) and tapered so that the outer diameter gradually gets smaller.

And the tightening portion (33) of the first connector (30) has slit (38) formed along the longitudinal direction of the handle. The first fastening section (32) of the first connector (30) may have slit (not shown) extending from the tightening portion (33).

And the mounting portion (35) is a portion where the first connector (30) is removably coupled to the supporting plate (21), and comprises in this embodiment the threads formed on the inner peripheral surface of the joint (31). That is, the inner diameter of the joint (31) constituting the lower part of the first connector (30) is formed larger than the handle (10) so that the inner peripheral surface of the lower part of the first connector is disposed at a predetermined distance apart from the outer peripheral surface of the handle (10). The inner peripheral surface of the lower part has threads so that it can be removably coupled to the threads (28) formed on the protrusion (27) of the supporting plate (21).

However, the coupling between the supporting plate (21) and the first connector (30) is not limited to a screw fastening type, and in the present invention, a variety of configurations may be employed to firmly couple or separate the supporting plate (21) and the first connector (30). In addition, the outer peripheral surface of the protrusion may have male threads and the inner peripheral surface of the first connector may have female threads. And through a structural change that the outer peripheral surface of the first connector has male threads and the protrusion is equipped with an annular member, the inner peripheral surface may have female threads.

In addition, the supporting plate (21) is not necessarily coupled to the first connector (30). Since the supporting plate is coupled to the first connector for a firm binding, it will be understood in the present invention that the mounting portion and the protrusion are selectively employed as needed.

On the other hand, the second connector (40) is fitted to the handle (10) and disposed on the upper part of the first connector (30). As with the first connector (30), the second connector (40) has inner diameter slightly larger than that of the handle (10) so as to enable the relative movement of the handle (10) and the second connector (40). The second connector (40) comprises the second fastening section (41) and the pressing portion (42). The second fastening section (41) has female threads on its inner peripheral surface so that it can be screwed to the first fastening section (32) of the first connector (30). The pressing portion (42) is formed upwardly extending from the second fastening section (41), and has inner diameter smaller than that of the tightening portion (33) of the first connector (30).

Figure 4:
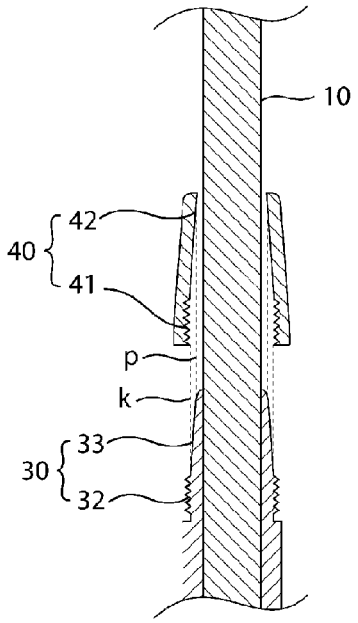
FIG. 4 a schematic cross-sectional view illustrating the coupling of the first connector and the second connector, more specifically the state before coupling connectors.

With reference to FIG. 4 and figure, the tightening portion (33) of the first connector (30) is formed in a tapered shape that the thickness is gradually reduced from the thickness indicated by a dotted line K to the thickness indicated by a dotted line P. And the inner diameter of the pressing portion (42) of the second connector (40) may be formed between the thicknesses indicated by dotted lines k and p or to be slightly smaller than the thickness indicated by the dotted line p. And the starting part of the tightening portion (33) is curved smoothly.

Figure 5:
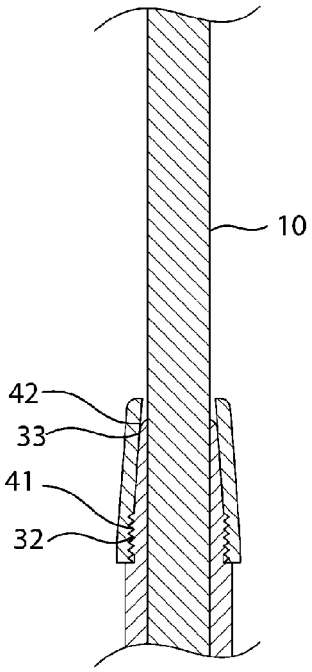
FIG. 5 is shows a connector-coupled state via screw fastening from the state of FIG. 4.

In the configuration above, the first connector (30) and the second connector (40) are screwed to the first fastening section (32) and the second fastening section (41). If the second connector (40) is moved and screwed to the first connector (30) while the first connector (30) and the second connector (40) are separated from each other as shown in FIG. 4, the coupling is made as shown in FIG. 5. In this process, the pressing portion (42) of the second connector (40) is strongly pressed to the tightening portion (33) of the first connector (30). That is, since the inner diameter of the pressing portion (42) of the second connector (40) is smaller than the outer diameter of the tightening portion (33) of the first connector (30), the pressing portion (42) is interference fitted to the tightening portion (33) in the process that the first connector (30) is screwed to the second connector (40). Accordingly, the first connector (30) is pressed by the second connector (40) so as to be completely adhered to the outer peripheral surface of the handle (10), firmly coupling the first connector (30) to the handle (10).

In particular, the tightening portion (33) of the first connector (30) has slits (38) along the longitudinal direction, and optionally the first fastening section (32) also may have slits (not shown). When the pressing portion (42) rotates and press the tightening portion (33) and the first fastening section (32), the first connector (30) can be firmly adhered to the handle (10) while the slits opened will be closed. However, even if the first connector do not have slits, because the first connector (30) is pressed toward the handle (10) while the pressing portion (42) with small inner diameter is interference fitted to the tightening portion (33), the first connector (30) can be firmly coupled to the handle (10).

Conversely, if the first connector (30) is uncoupled from the second connector (40), because the pressing force of the pressing portion (42) is released and the adhesiveness of the first connector (30) to the handle (10) becomes weak, the first connector (30) can have a relative movement to the handle (10).

On the other hand, the cover unit (55) is provided between the joint (31) of the first connector (30) and the first fastening section (32) in order to accommodate the upper part of the comb members (51) when the comb members (51) are adhered to the outer peripheral surface of the first connector (30) by the coupling band (22). The cover unit (55) is formed as a hemispherical concave shape to accommodate the upper part of the comb members (51).

In the broom (100) configured as above according to the present invention, the comb members (51) may change its position between the first mode and the second mode.

In other words, because the inference between the supporting plate (21) and the comb members (51) is reduced when the handle (10) is lowered approximately to the central part of the comb members (51, the comb members (51) are arranged in parallel to the handle (10) as shown in FIG. 1 and changed to the first mode, namely the narrow mode where the comb members (51) are spread over a length of approximately d1 on the drawing (The diameter is d1 in a circle).

In this state, if the handle (10) moves to the upper part of the comb members (51) after the first connector (30) is separated from the second connector (40) as shown in FIG. 2, the supporting plate (21) pushes the comb members (51) to the outer side and the comb members (51) are crossed forming a substantial angle to the placement direction of the handle (10). That is, the comb members (51) are spread wide and change to the second mode, namely the wide mode. The comb members (51) are spread over a length of approximately d2 on the drawing (The diameter is d2 in a circle). Of course, d1 in the narrow mode is much longer than d2 in the wide mode.

If the first connector (30) is coupled again to the second connector (40) in the wide mode, the first connector (30) is firmly coupled to the handle (10).

In addition, in the wide mode, because the comb members (51) that have been pushed to the outside by the supporting plate (21) try to elastically return to their original position, the comb members (51) apply pressure to the supporting plate (21). Therefore, the handle (10) needs to be coupled firmly to the conversion unit in the wide mode. As described above, it is possible in the wide mode that mounting portion (35) of the first connector (30) is screwed more firmly to the protrusion (27) of the supporting plate (21).

However, in the wide mode, it is possible to pull up the supporting plate (21) to some extent rather than in full measure to couple the plate to the mounting portion (35). In this case, the mounting portion (35) is not coupled to the protrusion (27). In other words, the user can adjust the opening angle of the comb members (51) by changing the position of the supporting plate (21).

As described above, the broom (100) can change between narrow mode and wide mode while the comb members (51) are arranged in parallel with the handle (10) or arranged to cross the handle (10) with a wide angle.

The narrow mode is suitable for sweeping narrow corners or when applying a force to the broom, while the wide mode is suitable for sweeping a large area at a time without spending a lot of force. In other words, it is possible to change the mode of the comb members between narrow mode and wide mode depending on the kind of cleaning objects or the nature of cleaning area.

In particular, the present invention is characterized in that a very simple structure is selected to change the modes of the comb members. For daily necessities such as a broom, an excessive production cost for implementing the function must be avoided. The present invention has advantages to change the mode of the broom by using the supporting plate (21), the first connector (30), and the second connector (40), as well as to significantly reduce the production costs.

Conventional brooms equipped with wide and narrow modes are too complex for an economical manufacturing and also have a problem with durability due to the complexity of the structure. That is, if the structure is complex, the number of components as well as assembly costs increase and a lot of component coupling parts are also required increasing costs and degrading durability. The present invention has a great practical significance in that it meets all of the functional requirements, economical efficiency, and durability with a simple configuration.

So far, it has been described that the connector portion, an element of the conversion unit, comprises the first connector (30) and the second connector (40), and that the conversion unit is firmly coupled to the handle (10) by the first connector (30) and the second connector (40) by a screw fastening method. However the configuration of the connector portion is not limited to this. In the present invention, once the hollow-shaped conversion unit comprises a tubular member (the first connector in this embodiment) to be fitted to the handle (10), a variety of methods to removably couple the tubular body to the handle (10) can be adopted (the second connector in this embodiment).

In other words, the connector portion is not necessarily split into the first connector and the second connector, and a variety of mechanical configurations can be adopted to firmly couple the first connector to the handle, including pin holes type. This example is described in the second embodiment.

Figure 6:
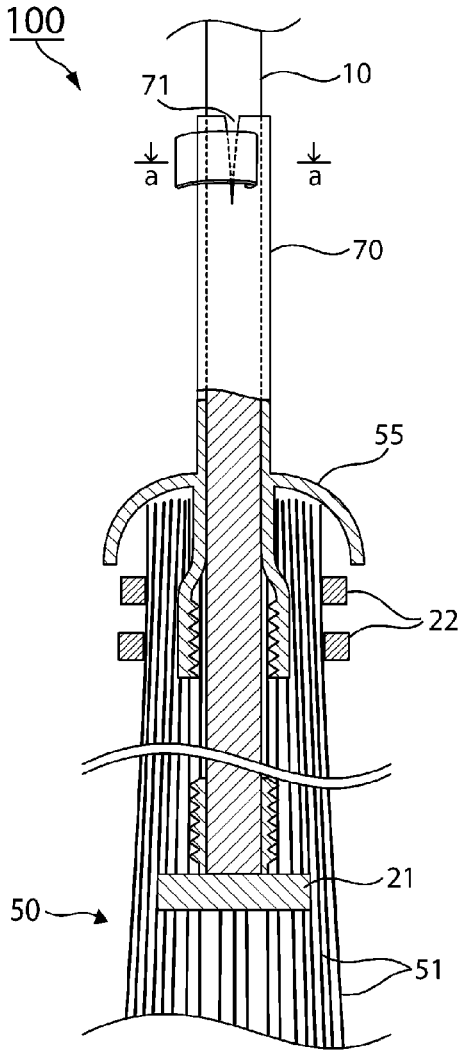
FIG. 6 is a schematic cross-sectional view of the cleaning broom according to the second embodiment of the present invention.
Figure 7:
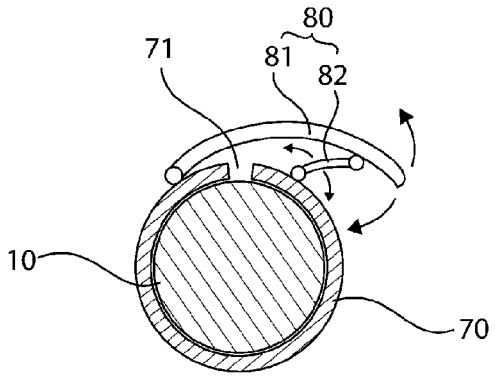
FIG. 7 is a schematic cross-sectional view of the A-A line of FIG. 6.
Figure 8:
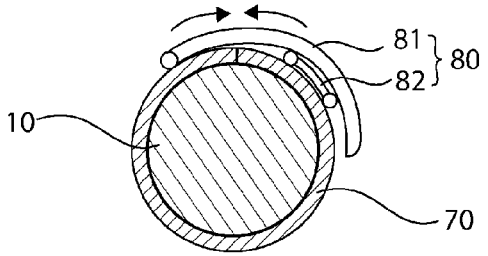
FIG. 8 is a schematic cross-sectional view of the buckle-closed state in FIG. 7.

The second embodiment of the present invention uses a buckle structure for the connector portion. The broom according to the second embodiment is illustrated in the FIGS. 6-8. FIG. 6 is a schematic cross-sectional view of the cleaning broom according to the second embodiment of the present invention. FIG. 7 is a schematic cross-sectional view of a-a line. FIG. 8 is a schematic cross-sectional view in the buckle-closed state in FIG. 7.

With reference to the FIGS. 6-8, in the broom according to the second embodiment, the configuration of the handle (10), the comb members (51), the supporting plate (21), and the coupling band (22) is the same as in the first embodiment.

However, in the connector portion of the second embodiment, the connecting rod (70) and the buckle (80) are used instead of the first connector and the second connector.

The connecting rod (70) is formed in a hollow tubular shape and fitted to the lower part of the handle (10). The inner diameter of the connecting rod (70) is slightly larger than the outer diameter of the handle (10) so that a relative movement is possible in the handle (10) while the connecting rod (70) is fitted. As with the first embodiment, the comb members (51) are adhered to the outer peripheral surface of the lower part of the connecting rod (70) by the coupling band (22). And the cover unit (55) is formed in the connecting rod (70) as with the first embodiment in order to gather the upper part of the comb members (51). The upper part of the connecting rod (70) is formed with incisions (71) cut in the longitudinal direction.

In addition, the lower part of the connecting rod (70) has an inner diameter larger than the outer diameter of the handle (10) so that the lower part of the connecting rod (70) has the mounting portion on its inner peripheral surface. The mounting portion has threads as with the first embodiment that can be screwed to the threads formed on the protrusion of the supporting plate.

The buckle (80) is to firmly couple the connecting rod (70) to the handle (10). The buckle (80) comprises the first locking portion (81) and the second locking portion (82) and has a similar structure to those employed in inline skates or ski boots.

That is, the first locking portion (81) and the second locking portion (82) are coupled with hinge to the connecting rod (70), and the first locking portion (81) is coupled with hinge to the second locking portion (82). And, although not shown, springs are interposed between the first locking portion (81) and the second locking portion (82) and the connecting rod (70) and between the first locking portion (81) and the second locking portion (82) in order to give an elastic force so that the buckle (80) is loosened after being fastened. Since the buckle (80) with such a configuration is a well-known member to those of ordinary skill in the art, further detailed description will be omitted.

As shown in FIG. 7, even though the incisions (71) of the connecting rod (70) are open while the first locking portion (81) is not coupled to the second locking portion (82), if the first locking portion (81) is rotated to close the buckle (80), the incisions (71) are forced to close as in FIG. 9. Accordingly, since the connecting rod (70) is adhered to the handle (10), the connecting rod (70) can be firmly coupled to the handle (10).

In the broom according to the second embodiment, it is possible to move the handle (10) in the vertical direction to change the mode of comb members (51) into wide mode or narrow mode after loosening the buckle (80) to make the connecting rod (70) and the handle (10) loose. When the mode change is completed, the buckle (80) is tightened to couple the connecting rod (70) to the handle (10).

The present invention may adopt various coupling structures including the first connector, the second connector, the connecting rod, and the buckle. That is, the relative movement of the handle is possible, and a variety of structures including holes and buttons can be adopted to rigidly couple the handle.

As described above, a very effective cleaning is possible in the present invention because the mode of the comb members can change between the first mode (narrow mode) and the second mode (wide mode).

Furthermore, since the comb members have a simple structure to change the mode, the broom is economical, durable and very practical as a daily necessity.

It will be understood that the technical configuration of the invention described above may be embodied in specific forms by those skilled in the art of the present invention without changing the technical idea or essential features of the present invention. Therefore, it should be understood that the embodiments described above are intended to be illustrative in all respects to be understood as non-limiting, that the scope of the present invention appears in the claims below rather than by the description above, and that the spirit and scope of the claims and all the changes or modified forms deriving from its equivalents fall within the scope of the present invention.

I claim:

1. A cleaning broom comprising:

a. a rod-shaped handle formed long in one direction so that the user can hold it by hand;

b. a comb portion comprising:

i. of multiple comb members, wherein the comb portion is attached to a lower part of the handle to sweep cleaning objects, wherein the multiple comb members are coupled to the handle along a longitudinal direction enabling a relative movement;

ii. a coupling band that is formed in a loop shape to be extended elastically, wherein the coupling band presses an upper part of the comb members to the handle so that the multiple comb members are adhered to the handle, and wherein the multiple comb members are coupled to an outer surface of the handle by the coupling band; and iii. a connector portion with a joint that is formed in a hollow tubular shape to be movably fitted to the lower part of the handle so that the comb members are adhered to the outer surface of the handle; and c. a conversion unit to adjust a placement angle of the multiple comb members between a first mode in which the multiple comb members are disposed in parallel with the handle and a second mode in which the multiple comb members are disposed crossing the handle, wherein a conversion unit comprises a supporting plate having cross-sectional area larger than that of the handle and coupled to the lower part of the handle, wherein the multiple comb members change to the first mode when the handle moves to a lower part of the multiple comb members and to the second mode when the handle moves to an upper part of the multiple comb members that are pushed outside by the supporting plate.

2. The cleaning broom of claim 1, wherein the connector portion comprises a first connector and a second connector, where the first connector is formed in a hollow tubular shape to be movably fitted to the lower part of the handle, wherein the first connector comprises a first fastening section extending from the joint and having male threads on its outer peripheral surface, wherein a tightening portion extends from a rear end of a first screw part having a decreasing outer diameter along the longitudinal direction of the handle; and the second connector is formed in a hollow tubular shape to be fitted to the handle wherein the second connector is screwed to the first connector, wherein the second connector comprises a second fastening section having male threads on its inner peripheral surface and a pressing portion extended from the second fastening section with an inner diameter smaller than that of the tightening portion, wherein when the second connector is screwed to the first connector, the pressing portion presses the tightening portion toward the handle so that the first connector is interference fitted to the handle.

3. The cleaning broom of claim 2, wherein the tightening portion of the first connector comprises a slit portion cut along the longitudinal direction of the handle.

4. The cleaning broom of claim 2, wherein the first connector comprises a cover unit that is formed along a radial direction of the handle and covers the upper part of the comb members between the joint and the coupling portion.

5. The cleaning broom of claim 1, wherein the connector portion comprises a mounting portion that allows the supporting plate to be removably coupled.

6. The cleaning broom of claim 5, wherein the supporting plate has a hollow protrusion on its back side to be fitted to the handle, and wherein the mounting portion of the connector portion is removably coupled to the protrusion of the supporting plate.

7. The cleaning broom of claim 6, wherein threads are formed on the hollow protrusion of the supporting plate and on the mounting portion of the connector portion so that the supporting plate is screwed to the connector portion.

8. The cleaning broom of claim 1, wherein the multiple comb members are made of coconut wood.

* * * * *